United States Patent [19]

DeHart et al.

[11] 3,939,081

[45] Feb. 17, 1976

[54] LOAD SUPPORTING LUBRICANT

[75] Inventors: Arnold O. DeHart, Rochester; Richard C. Rosenberg, Romeo; Edward G. Trachman, Troy, all of Mich.

[73] Assignee: General Motors Corporation, Detroit, Mich.

[22] Filed: Jan. 29, 1975

[21] Appl. No.: 544,911

[52] U.S. Cl. ..... 252/12; 252/26

[51] Int. Cl.[2]. C10M 5/00; C10M 7/00; C10M 1/10; C10M 3/02

[58] Field of Search ..... 252/12, 12.2, 12.4, 12.6, 252/26

[56] References Cited

UNITED STATES PATENTS 3,549,531 12/1970 Santl ..... 252/12

FOREIGN PATENTS OR APPLICATIONS 697,108 11/1964 Canada ..... 252/12

*Primary Examiner*—Delbert E. Gantz
*Assistant Examiner*—I. Vaughn
*Attorney, Agent, or Firm*—G. A. Grove

[57] ABSTRACT

In accordance with a preferred embodiment of this invention a load supporting lubricant is formed by combining from about 40% to about 60% by volume of a petroleum grease with the balance being small, hard, uniformly sized, steel spheres dispersed throughout the grease. The diameter of the spheres should be within the range of from about ½ to about ¾ millimeters (hereinafter mm) to achieve the minimum coefficient of static friction which is typically about 0.001 or less. When disposed between slidably engaged surfaces, each of said spheres is free to roll at random as one surface moves relative to the other.

3 Claims, 1 Drawing Figure

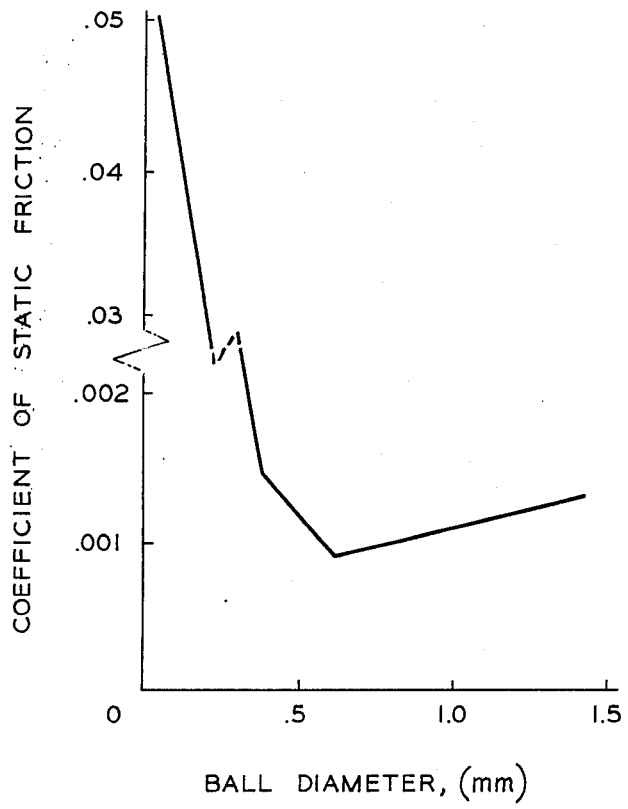
.05
.04
.03
.002
.001
0
.5
1.0
1.5
COEFFICIENT OF STATIC FRICTION
BALL DIAMETER, (mm)

LOAD SUPPORTING LUBRICANT

FIELD OF THE INVENTION

This invention relates to a load supporting lubricant formed by dispersing small uniformly sized spheres in a binder fluid.

BACKGROUND OF THE INVENTION

During the operation of any machine having slidably engaged metal surfaces, friction consumes energy. In the lubricant and bearing arts, there is a continuous effort directed at developing various ways of reducing the coefficients of static and dynamic friction between such surfaces and thereby minimizing these losses. The arts have progressed to the stage where a gain of a few percent is significant.

Early in the practice of these arts, rolling friction was substituted for sliding friction wherever feasible. Typically, this was accomplished by the use of caged or uncaged rolling elements such as balls or rollers. This development significantly reduced friction and provided a separate load supporting means between the slidably engaged surfaces. However, this development also added significantly to the cost of the machines when compared to the simple boundary lubrication provided by a thin film of oil or grease.

Recently, the use of hard microspheres made of iron, tungsten, nickel and the like and having a diameter of preferably less than 8 microns, as a lubricant, was disclosed in U.S. Pat. No. 3,549,531. This development provided about a 50 percent reduction in the friction of slidably engaged surfaces when compared to that of the simple boundary lubrication. More specifically, when dispersed in an oil or grease these microspheres, of the size disclosed in U.S. Pat. No. 3,549,531, provide a coefficient of friction between two slidably engaged surfaces of about 0.05.

OBJECTS OF THE INVENTION

It is an object of this invention to provide an easily handled lubricating composition which, when placed between two slidably engaged surfaces, provides a load supporting capacity of about 3,500 kPa, and a coefficient of static friction of about 0.001 or less which is about 100 times less than that provided by a simple boundary lubricant, wherein said lubricant is a dispersion of hard uniformly sized spheres having a diameter of from about ½ to 4 mm in a binder fluid.

It is a further object of this invention to provide an easily handled lubricating composition which, when placed between two slidably engaged surfaces, provides a coefficient of static friction which is about 50 times less than that provided by a lubricant consisting of a binder and hard microspheres having a diameter of about 4 to 8 microns.

It is a still further object of this invention to provide a lubricant composed of hard spheres in a binder fluid wherein the diameter of the spheres is at about that point, within the range of from ½ to 2 mm, so as to provide an unexpected minimum coefficient of static friction between two slidably engaged surfaces.

SUMMARY OF THE INVENTION

In accordance with a preferred embodiment of this invention, a lubricating composition is formed by uniformly dispersing small, hard steel spheres in a grease. The diameter of the spheres may vary from about ½ to about 4 mm and are preferably from about ½ to ¾ mm. The spheres preferably form a single closely packed layer between the two slidably engaged surfaces and the grease completely fills the interstices formed thereby. In this configuration, the grease forms about 40 percent by volume of the subject lubricating composition, and the spheres are free to roll at random when disposed between slidably engaged moving surfaces.

The load supporting capacity of the subject lubricating composition will depend on the hardness of the steel spheres and of the slidably engaged surfaces, and it has been learned that if the hardness is about 60 on the Rockwell C scale, the subject lubricating composition will have a load supporting capacity of about 3,500 kPa, which is about 500 pounds per square inch of the slidably engaged surfaces. However, the load supporting capacity will be reduced if there is a significant degree of nonuniformity in the size of the spheres. This is to be expected as in this situation the number of spheres actually supporting in the load will be reduced. However, the experimental work which led to the subject development was conducted with commercially available spheres sold in AFBMA (Anti-Friction Bearing Manufactures Association) Grade 25. This grade has relatively lenient tolerances of about ± 25 millionths of an inch. Preferably, the spheres are made from a corrosion resistance steel such as stainless steel 440 C.

The grease in the subject composition serves as a lubricant but more importantly as a binder which ensures an easily handled composition when compared to small, loose spheres. The exact composition of the grease is not critical as long as it has sufficient cohesiveness to hold the spheres and does not corrode or, in any other manner, degrade the slidably engaged surfaces. Preferably, the grease would inhibit the corrosion of the spheres and the surfaces.

The subject lubricating composition provides the following advantages:

1. In general, exceptionally low coefficients of dynamic and static friction between two slidably engaged surfaces, and in particular an unexpected minimum in the coefficient of static friction;
2. Very high stiffness which is desirable in precision tool machines;
3. A high load supporting capacity in the range of about 3,500 kPa;
4. Low cost and ease of handling.

These and other advantages of the subject invention will be more easily understood in view of a detailed description thereof to include specific examples.

DETAILED DESCRIPTION OF THE INVENTION

In accordance with this invention a superior load supporting lubricant is formed by dispersing hard spheres having a diameter in the range of from about ¼ mm to 4 mm dispersed in a binder fluid which may constitute from 20 percent to 80 percent by volume of the total composition. It has been discovered that an optimum lubricant, in terms of providing the minimum coefficient of static friction between slidably engaged surfaces, is formed when the diameter of the spheres is held within the range of from about ½ to about ¾ mm. A coefficient of static friction between slidably engaged hardened steel surfaces of less than 0.001 is typical and this value is about 100 times less than that provided by a thin film of oil or grease. However, as the diameter of the spheres is either increased or decreased from this optimum value, the coefficient of static friction increases. (See FIG. 1, a graph of the coefficient of static friction vs. ball diameter.) The physical reason for this minimum point is not understood at this time and it was totally unexpected.

The lubricant described in the aforementioned U.S. Pat. No. 3,549,531 comprising microspheres having a preferred size of about 4 to 8 microns provides a coefficient of friction which is about ½ of that provided by the boundary lubrication of a thin film of grease or oil. On the other hand, a subject lubricant provides a coefficient of friction which is about 100 times below the boundary lubrication value. The reason for this dramatic improvement achieved by increasing the diameter of the spheres is also unexplained at this time but tends to indicate a totally distinct phenomenon. Equally unexpected was the gradual but well defined increase in the coefficient of static friction which occurs as the diameter of the spheres was increased beyond about 1 or 1 ½ mm.

The advantages of the subject lubricant make it very desirable in many applications and particularly so in precision tool machines. The stiffness of the subject lubricant which is near $1.9 \times 10^{12}$ newtons per meter per square meter, if the hardness of the balls is about 60 on the Rockwell C scale, is one of the features of the subject lubricant which makes it desirable in such machine applications because it minimizes deflection at the bearing surfaces and allows the machine to maintain closer tolerances.

Ground and hardened steel spheres are available in diameters as small as 0.4 mm and in many dimensional tolerance grades labeled from 3 to 1,000. The grade number represents the permissible dimensional variations in millionths of an inch. Grade 25, which has a maximum variation of plus or minus 25 millionths of an inch is suitable in the subject lubricant application. It is again noted that an increase in the maximum dimensional variation will primarily affect the load supporting capacity of the lubricant. In addition, such an increase also reduces the cost of the spheres; therefore, the highest numbered grade, suitable for the loading conditions of a specific application should be used to minimize cost. Grade 25 will support about 3,500 kPa or about 500 pounds per square inch of bearing surface. This appears to be near the maximum value as the stresses on the spheres is above 500,000 psi.

Since the grease serves primarily as a retainer for the spheres and secondarily as a lubricant, its physical and chemical properties are not critical in the subject application. However, the grease should not create a corrosive environment for either the slidably engaged surfaces or the spheres. Understandably, the grease would preferably act to protect both the slidably engaged surfaces and the spheres from the environment. Suitable binder fluids would include typical known lubricants in the form of a grease or an oil; these may be petroleum based, mineral, synthetic, animal, or vegetable.

The volumetric ratio of binder fluid to spheres would dictate the number of spheres within a specific lubricating area. Therefore, this parameter would influence the load supporting capacity of the lubricant. In heavy loading applications, the binder fluid should constitute 40 percent by volume of the subject lubricant or less because at 40 percent the binder fluid would only fill the interstices of a closely packed sphere array; this would allow the maximum number of spheres to occupy a unit area. In lighter loading applications, the subject lubricant may be thinned or diluted with a suitable lubricating binder fluid, up to about 80 percent, without a significant loss of the superior lubricating properties of the subject composition.

It is to be noted that the slidably engaged surfaces and the spheres must have a sufficiently smooth surface to allow the spheres to roll at random as the surfaces move across one another. If this does not occur, sliding instead of rolling friction may occur and the lubricating properties of such a bearing would predictably be much more poorer.

EXAMPLE I

In accordance with the practice of this invention, a lubricant comprising about equal parts by volume of a white petroleum jelly and, dispersed therethrough, Grade 25 precision ground spheres having a diameter of about 0.64 mm with a dimensional tolerance of plus or minus 25 millionths of an inch. The spheres were made from 440 C stainless steel which contains by weight: (a) from 0.95% to 1.2% carbon; (b) a maximum of 1% manganese; (c) a maximum of 1% silicon; (d) a maximum of 0.04% phosphorus; (e) a maximum of 0.03% sulfur; and (f) from 16.00% to 18.00% chromium and had a hardness of about 60 on the Rockwell C scale. White petroleum jelly is a purified mixture of semi-solid hydrocarbons obtained from petroleum, which jelly has been wholly or nearly wholly decolorized.

The lubricant was then evaluated in a simple laboratory apparatus, which employed direct loading with dead weights, to establish both the normal load and to determine the friction force. This appparatus ensures uniform loading over the lubricant composition. More specifically, the apparatus consisted of two parallel plates having a surface area of 100 mm square and a thickness of 25 mm. The plates were made from tool steel, SAE 01 which contains about 0.9 percent carbon, 1.0 percent manganese, 0.5 percent chromium, and 0.5 percent tungsten. The hardness of these plates was also about 60 on the Rockwell C scale.

To evaluate the lubricant, the lower plate was initially set on a large steel platform and leveled by three jack screws to within $5 \times 10^{-5}$ mm per mm. After the mating surfaces of both plates were cleaned with acetone, a portion of the lubricant was placed on the top surface of the bottom plate at each of the verticies of an equilateral triangle so that the normal loading vector passed through the centroid of the triangle. This ensured a uniform loading of each portion of the lubricant. The top plate was then set on the lubricant and loaded with weights. The normal force is reported in units of mega newtons per square meter of lubricant which normalizes the data with respect to the number of spheres supporting the applied load. A string was attached to the top plate and passed over a pulley which was supported by an externally pressurized air bearing. The friction in the air bearing is negligible at the speeds and loads involved in this study.

The friction force required to move the upper plate was determined by the weight attached to the string. The force of static friction is the smallest force required to start the upper plate moving and the coefficient of static friction would be the ratio of the friction force to the normal load. Under a load of 0.95 mega newtons per square meter of lubricating area, the coefficient of static friction was about 0.00095 and a coefficient of dynamic friction was about 0.0007. The force of dynamic friction is that force required to maintain movement once it has begun and the ratio of the dynamic of friction force to the normal loading is the dynamic coefficient of friction.

This procedure was repeated using Grade 25 spheres having a diameter of about 0.4 mm. Under a load of 0.95 mega newtons per square meter of lubricating area, the coefficient of static friction was about 0.00157 and the coefficient of the dynamic friction was about 0.0011.

This same procedure was again repeated with Grade 25 spheres having a diameter of 1.59 mm. These spheres were made from a chrome alloy carbon steel and had a hardness also of about 60 on the Rockwell C scale. Under a load of 0.95 mega newtons per square meter, the lubricant formed with these spheres had a coefficient of static friction of 0.00145 and a coefficient of dynamic friction of 0.0006.

The coefficients of static friction for these spheres were also measured under loads of 11.28 kilograms and 20.36 kilograms. The data is reported in Table I below. The coefficients of dynamic friction, under these loading conditions are also reported in Table I.

Table I

| | Coefficient of Friction Data Applied Load (Mega Newtons Per Square Meter) | | | | | |
|---|---|---|---|---|---|---|
| | 0.95 | | 2.4 | | 4.3 | |
| | Static | Dynamic* | Static | Dynamic* | Static | Dynamic* |
| Microsphere Size (mm) | | | | | | |
| 0.40 | 0.00157 | 0.0011 | 0.00142 | 0.0008 | 0.00123 | 0.0011 |
| 0.64 | 0.00095 | 0.0007 | 0.00089 | 0.0005 | 0.00103 | 0.0006 |
| 1.59 | 0.00145 | 0.0006 | 0.00133 | 0.0005 | 0.00179 | 0.0007 |

*The coefficient of dynamic friction was measured at a slow relative velocity of less than ¼ inch per second.

In conducting these experiments, the number of spheres in each of the three patches was monitored and each array was initially placed in a rectilinear or "square packed" configuration. (However, this specific configuration was not necessarily maintained during operation.) More specifically, when the largest spheres (1.59 mm) were evaluated, 18 were used and they initially occupied $45.5 \times 10^{-6}$ square meters; when the intermediated spheres were evaluated, 114 were used and they initially occupied $46.6 \times 10^{-6}$ square meters; and when the smallest spheres were evaluated 285 were used and they initially occupied $45.6 \times 10^{-6}$ square meters. A strength analysis of the various spheres, under load, indicated that the load capacity of the lubricant is independent of sphere diameter. However, for a given size sphere, the load capacity is directly related to the number of spheres in the contact area.

EXAMPLE II

To gain a better understanding of the lubricating properties of microspheres, the lubricant described in the Santt U.S. Pat. No. 3,549,531 was prepared in accordance with the teachings of that document. Specifically, a hardened spherical metal powder (sized to 40 microns plus or minus ten percent) was mixed with the binder fluid (white petroleum jelly) used in the subject lubricant. This is within the teaching of the Santt patent as seen in Column 3. This lubricant was then evaluated using the same equipment and procedures described in Example I. Under a load of 0.98 mega newtons per square meter, the coefficient of static friction as measured in accordance with the procedures described in Example I was 0.05. This value which agrees with the FIG. 2 in the patent which indicates that the Santt lubricant provides about a 50 percent reduction in the coefficient of friction of the boundary lubrication provided by a simple film of grease which is typically about 0.1. This value is supported in the 43rd edition of CRC's *Handbook of Chemistry and Physics* at p. 2181. The coefficient of static friction of steel on steel varies from about 0.08 to 0.2 if lubricated with typical lubricating oils.

While our invention has been described in terms of certain specific embodiments, it will be appreciated that other forms thereof could readily be adapted by one skilled in the art. Therefore, the scope of our invention is not to be limited to the specific embodiments disclosed.

What is claimed is:

1. A load supporting lubricant disposed between two slidably engageable surfaces consisting essentially of:

1. a binder fluid; and

2. a single layer of hard, uniformly sized spheres between the surfaces having a diameter in the range of from about ¼ mm to about 4,0 mm, dispersed through said fluid; each of said spheres being able to roll at random between said surfaces in engaging load supporting relationship therewith and through said binder fluid as one of said surfaces moves relative to the other.

2. A load bearing arrangement comprising slidably engageable surfaces having a load supporting medium disposed between the surfaces, said medium consisting essentially of:

1. from 20 to 80 percent by volume of a petroleum grease; and

2. the balance being a single layer of hard, uniformly sized spheres between the surfaces having a diameter in the range of from about ¼ mm to about 4.0 mm, dispersed through said fluid; each of said spheres being able to roll at random between said surfaces in engaging load supporting relationship therewith and through said binder fluid as one of said surfaces moves relative to the other.

3. In a load bearing arrangement comprising slidably engageable surfaces having a load supporting medium disposed between the surfaces, the medium consisting essentially of:

1. a binder fluid; and

2. a single layer of hard uniformly sized spheres between the surfaces in engaging load supporting relationship therewith, the spheres having a diameter of from about ½ to about ¾ mm so as to provide a minimum coefficient of static friction and the spheres having a uniform hardness in the range of from about 55 to 65 (Rockwell C) and each of the spheres being able to roll at random between the surfaces as one of the surfaces moves relative to the other and the spheres also being able to move through the binder fluid which is dispersed relatively uniformly throughout said layer of spheres.

* * * * *